US006722163B2

(12) United States Patent
Ando'

(10) Patent No.: US 6,722,163 B2
(45) Date of Patent: Apr. 20, 2004

(54) METHOD FOR FORMING A POUCH IN A TUBULAR KNITTED ARTICLE WITH A CIRCULAR KNITTING MACHINE

(75) Inventor: Jan Ando', Scandicci (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 10/392,005

(22) Filed: Mar. 19, 2003

(65) Prior Publication Data

US 2003/0182974 A1 Oct. 2, 2003

(30) Foreign Application Priority Data

Mar. 26, 2002 (IT) ..... MI2002A0630

(51) Int. Cl.[7] ..... D04B 1/26
(52) U.S. Cl. ..... 66/51; 66/187
(58) Field of Search ..... 66/51, 46, 48, 66/52, 53, 172 R, 173, 179, 186, 187

(56) References Cited

U.S. PATENT DOCUMENTS 2,926,513 A * 3/1960 Tew ..... 66/187
4,644,761 A * 2/1987 Chatzipetros et al. ..... 62/51.1
5,095,719 A * 3/1992 Philip ..... 66/8
5,170,646 A * 12/1992 Gariboldi ..... 66/51
6,003,345 A * 12/1999 Jordan ..... 66/215

* cited by examiner

*Primary Examiner*—Danny Worrell
(74) *Attorney, Agent, or Firm*—Welsh & Katz, Ltd.

(57) ABSTRACT

The method comprises using a set of contiguous needles of the needle cylinder; actuating the needle cylinder with an alternating rotary motion about its own axis, through a rotation angle making the knitting needles to pass in front of n feeds or drops of the machine which are used to form the pouch; gradually decreasing the needles made to knit at least one of the n feeds, excluding every time needles located at the lateral ends of the set in at least one step of the knitting process; and gradually increasing, at the lateral ends of the set, the needles that are made to knit at least one of the n feeds in at least one other step of the knitting process.

8 Claims, 3 Drawing Sheets

METHOD FOR FORMING A POUCH IN A TUBULAR KNITTED ARTICLE WITH A CIRCULAR KNITTING MACHINE

BACKGROUND OF THE INVENTION

The present invention relates to a method for forming a pouch in a tubular article, particularly for forming the heel or toe of hosiery items, with circular hosiery knitting machines having at least two feeds or drops.

As is known, in the conventional production of hosiery items with circular machines the heel and toe of the hosiery item are formed by using a single feed or drop of the machine and by actuating the needle cylinder with an alternating rotary motion about its own axis through a rotation angle of approximately 180°, so as to make one half of the needle cylinder pass at said feed or drop. The needles of this half of the needle cylinder are made to knit at the feed or drop being considered, and their number is gradually decreased, increasing the number of needles excluded from knitting starting from the lateral ends of the set, in a first step, and gradually increased in a second step, so as to achieve the characteristic pouch-like shape for the heel and the toe.

Formation of the heel and toe of the hosiery item, due to the need to actuate the needle cylinder with an alternating rotary motion about its own axis and at a reduced speed owing to the fact that the direction of rotation of the needle cylinder must be reversed cyclically, considerably affects the overall duration of the production cycle of the hosiery item.

In order to reduce the time required to form the heel and toe of hosiery items, methods have been proposed which allow to form a pouch at the heel and at the toe by actuating the needle cylinder with a continuous rotary motion about its own axis and by interrupting, by cutting the thread, the additional rows of stitches that form the pouch. Although these methods unquestionably speed up the hosiery item production cycle, they have the drawback of producing a hosiery item that is not fully satisfactory both from an aesthetic standpoint and in terms of comfort because of the presence of the cut trailing threads on the reverse side of the hosiery item.

Other methods have also been proposed which consist in forming pouch-like knitting by again actuating the needle cylinder with an alternating rotary motion about its own axis but by using a larger number of feeds to form the pouch.

These other methods have the drawback of producing a pouch that is not fully satisfactory from an aesthetic standpoint, since holes are formed in the regions of the pouch that correspond to the reversal of the rotary motion of the needle cylinder about its own axis that increase in size as the number of feeds used increases.

Other proposed methods that use multiple feeds, aimed at reducing these shortcomings from an aesthetic standpoint, are unsuitable to provide the characteristic shape for the heel and toe of hosiery items.

SUMMARY OF THE INVENTION

The aim of the present invention is to solve the problems described above, by providing a method for forming a pouch in a tubular article, particularly for forming the heel or toe of hosiery items, with circular hosiery knitting machines having at least two feeds, which allows to obtain, in significantly shorter times than required by conventional knitting, a pouch whose degree of finishing is comparable with the degree of finish that can be obtained with conventional heel or toe knitting.

Within this aim, an object of the invention is to provide a method that allows to provide a pouch in a tubular article, particularly a heel or toe of hosiery items, that is fully satisfactory also as regards comfort.

This aim and this and other objects that will become better apparent hereinafter are achieved by a method for forming a pouch in a tubular article, particularly for forming the heel or toe of hosiery items, with circular hosiery knitting machines having at least two feeds, characterized in that it consists in using a set of contiguous needles of the needle cylinder; in actuating the needle cylinder with an alternating rotary motion about its own axis, through a rotation angle that is suitable to make the needles of said set that are made to knit pass in front of n feeds or drops of the machine which are used to form the pouch; in gradually decreasing the needles made to knit at least one of said n feeds, excluding every time needles located at the lateral ends of the set in at least one step of the knitting process; and in gradually increasing the needles made to knit at least one of said n feeds at the lateral ends of the set in at least one other step of the knitting process, each one of the two end regions of the pouch being formed by means of at least two needles that are made to knit at one of said n feeds, one of said two end regions being formed with one of said n feeds, the other of said two end regions being formed with another one of said n feeds.

BRIEF DESCRIPTION OF THE DRAWINGS

Further characteristics and advantages of the present invention will become better apparent from the description of a preferred but not exclusive embodiment thereof, illustrated only by way of non-limitative example in the accompanying drawings, wherein.

DESCRIPTION OF THE PREFERRED EMBODIMENTS

Figure 1:
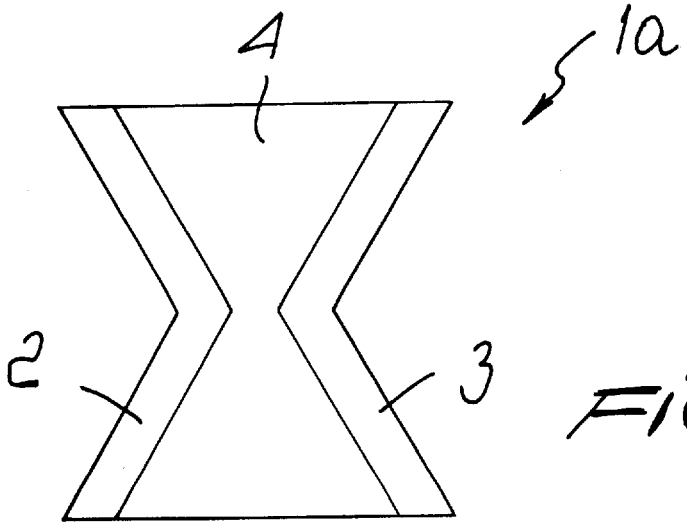
FIG. 1 is a schematic view of a pouch that can be obtained with the method according to the invention, by using two feeds or drops of the machine.

The method according to the invention consists in using, in order to form a pouch, designated by the reference numerals 1*a*, 1*b*, 1*c*, 1*d*, 1*e*, 1*f* in its various configurations, a set of contiguous needles in the needle cylinder. The needle cylinder is actuated with an alternating rotary motion about its own axis, with a rotation angle that is suitable to make the needles of said set that are made to knit pass in front of n feeds or drops of the machine that are used to form the pouch. The number of needles made to knit at least one of the n feeds is reduced gradually, excluding in each instance the needles located at the lateral ends of the set, in at least one step of the knitting process, and is gradually increased, again at the lateral ends of the set, in at least one other step of the knitting process. The two end regions of the pouch, designated by the reference numerals 2 and 3, are each provided with at least two needles for each lateral end of the set of needles that are made to knit. One of these two end regions is formed with one of the n feeds and the other one of said two end regions is formed with another one of the n feeds.

Conveniently, the feeds of the n feeds used to form the two end regions 2 and 3 of the pouch are respectively the first and last feeds encountered by the set of needles in the alternating rotary motion of the needle cylinder about its own axis.

The central region of the pouch, designated by the reference numeral 4, is formed by using all n feeds.

Preferably, in the set of needles that is used to form n rows of stitches in the forward motion of the needle cylinder and n rows of stitches in the return motion of the needle cylinder, at least two needles located at a lateral end of the set are made to knit exclusively at the first of the n feeds encountered in the forward motion and at the last feed (i.e., always the same feed) encountered in the return motion, while at least two needles located at the other lateral end of the set are made to knit exclusively at the last of the n feeds encountered in the forward motion and at the first feed (i.e., again the same feed) encountered in the return motion, increasing or decreasing by at least one needle, starting from the lateral ends of the set, the number of needles made to knit at at least one feed at each reversal of the motion of the needle cylinder.

Figure 8:
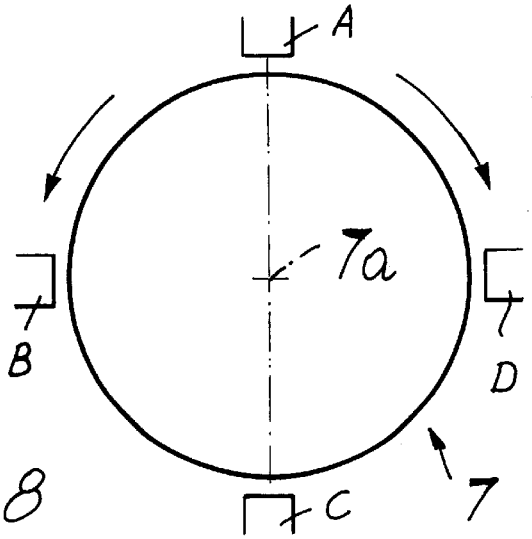
FIG. 8 is a schematic top plan view of a circular knitting machine with four feeds or drops that can be used to perform the method according to the invention.

The number n of feeds used to form the pouch is preferably comprised between 2 and 4, which can be provided in suitable arrangements around the needle cylinder of the machine. FIG. 8 shows a configuration with 4 feeds, but only 2 or 3 can be provided.

Figure 2:
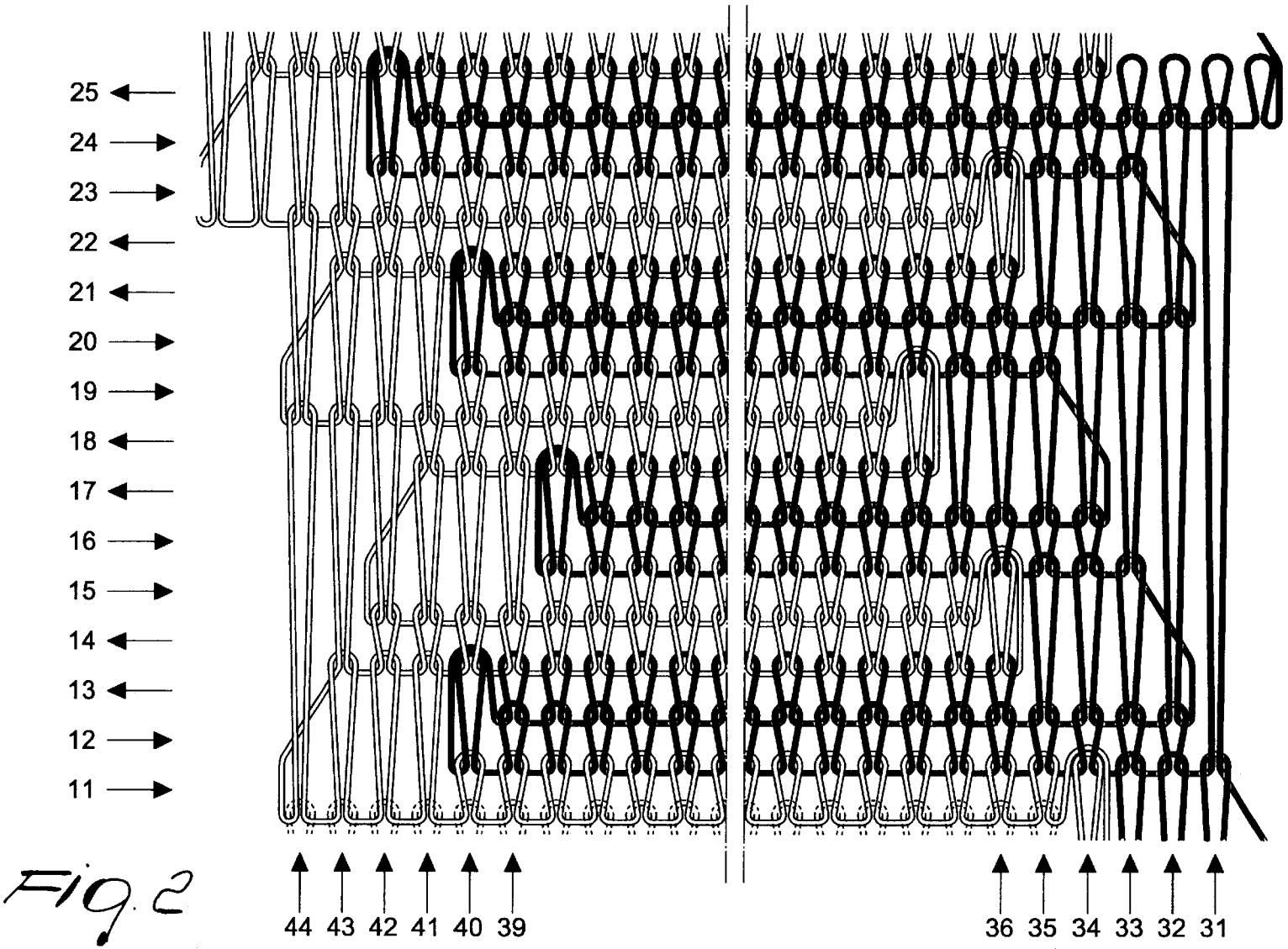
FIG. 2 is an enlarged-scale schematic view of a portion of FIG. 1.

For the sake of greater clarity, the method according to the invention is now explained in detail with particular reference to FIGS. 1 and 2.

FIG. 1 illustrates schematically a pouch la, which has been spread out flat for the sake of greater clarity, it being understood that in the actual execution the perimetric oblique edges located on a same side of the pouch are joined together.

The pouch 1*a* shown in FIG. 1 is a pouch that is formed by using two feeds. In said pouch there is a central region 4, which is formed by using two feeds, and there are two end regions 2 and 3, which are formed respectively by using one feed and the other feed of said two feeds.

The pouch 1*a* is formed by using a set of needles that is gradually decreased in a first step of the knitting process and is gradually increased in a second step of the knitting process.

FIG. 2 is an enlarged-scale view of a detail of FIG. 1, which relates to a region of the pouch that is proximate to the intermediate region of its extension, i.e., proximate to the region where transition from the first step to the second step occurs.

The rows of stitches have been designated by the reference numerals 11 to 25. Next to the number of each row of stitches there is a horizontal arrow, which indicates the direction of the motion of the needle cylinder 7 with respect to the feeds or drops during the forming of that row of stitches.

Some rows of loops of knitting, each formed by a same needle and referenced in the description that follows, have been indicated with numbered arrows.

The loops of knitting, if the pouch is not tensioned, actually all have substantially the same length. In the drawing, some loops have been extended necessarily in order to be able to show the pouch extended flat and still maintain the connection between the various loops of knitting.

It is also assumed that in the formation of the pouch the needle cylinder 7, actuated with an alternating rotary motion about its own axis 7*a*, passes with the set of needles that must form the pouch, during the forward rotation, first at a feed A and then at a feed B and then, in the return rotation, passes first at the feed B and then at the feed A. The thread dispensed by the feed A is shown in white (only contour lines), while the thread dispensed by the feed B is shown in black (with the space within the contour lines blacken).

Considering now the formation of the rows of stitches 11 and 12, during the forward motion of the needle cylinder 7 some end needles (at least two), specifically four needles (whose position is indicated by the arrows 31, 32, 33 and 34) located at the lateral end (to the right in the drawing) of the set of needles that passes first at the feeds A and B are not actuated at the feed A and therefore do not pick up the (white) thread dispensed at said feed, but pick up the (black) thread dispensed at the feed B, forming new loops of knitting and knocking over the loops of knitting formed previously.

The other needles of the set work both at the feed A and at the feed B, except for a certain number of end needles (at least two), specifically four needles (whose position is indicated by the arrows 41, 42, 43, 44) located at the opposite end of the set of needles (to the left in the drawing) that passes last at the feeds A and B. Said four end needles knit exclusively at the feed A, knocking over the loops of knitting formed previously.

In the return motion of the needle cylinder, in order to form the rows of stitches 13 and 14, the set of needles that must form the pouch passes first at the feed B and then at the feed A. During this return motion, the needle of the set (the needle designated by the arrow 44) that will be the first to pass in front of said feeds is excluded from knitting, while the four contiguous needles (the ones designated by the arrows 43, 42, 41, 40) are actuated exclusively at the feed A and will form new loops of knitting by knocking over the loops of knitting formed previously. The other needles of the set are actuated both at the feed B and at the feed A, except for the four end needles (the needles designated by the arrows 35, 34, 33, 32), which are actuated exclusively at the feed B, while the needle of the set (indicated by the arrow 31) that will be the last to pass at these feeds is excluded from knitting.

When the motion of the needle cylinder is reversed again to form the rows 15 and 16, the end needle (indicated by the arrow 32) is excluded from knitting and the four end needles (indicated by the arrows 33, 34, 35 and 36) knit exclusively at the feed B. The remaining needles of the set knit both at the feed A and at the feed B, except for the end needles (indicated by the arrows 39, 40, 41 and 42), which knit exclusively at the feed A. The end needle (indicated by the arrow 43) is excluded from knitting. Knitting continues in this manner until the rows 19 and 21 are formed, at which the number of needles of the set made to knit respectively at the feed A and at the feed B is gradually increased. As can be noted, the row 19 is in fact formed by making three extra needles (indicated by the arrows 42, 43 and 44) knit at the feed A with respect to the preceding row 18; said three needles, together with the contiguous needle (indicated by the arrow 41), knit exclusively at the feed A, and the row 21 is formed by making three extra needles (indicated by the arrows 32, 33 and 34) knit at the feed B; said three needles, together with the contiguous needle (indicated by the arrow 35), are made to knit exclusively at the feed B.

In practice, starting from the rows 19 and 21, the needles that had been gradually excluded from knitting in the preceding rows are gradually made to knit again.

In the pouch 1*a* of FIG. 1, the number of needles that knit exclusively at one of the two feeds in forming the end regions 2 and 3 remains constant. In this manner, the width of the end regions 2 and 3 remains constant along the extension of the pouch 1*a*.

Figure 3:
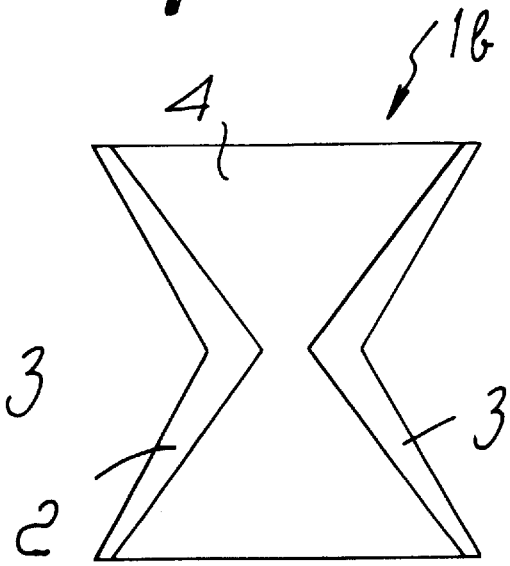
FIGS. 3 to 6 illustrate other possible configurations of the pouch that can be obtained with the method according to the invention, by using two feeds or drops.

FIG. 3 illustrates a pouch 1*b*, which is obtained like the pouch 1*a* of FIG. 1, except that the number of needles that knit exclusively at one feed or the other in forming the end regions 2 and 3 is increased gradually, while the total needles of the set used to form the pouch are gradually decreased. In this manner, the contour of the central region 4 of the pouch, formed by using two feeds, is different from the outer contour of the pouch and the end regions 2 and 3 first gradually widen and then gradually taper. With this solution, the joining lines of the stitches at which the motion of the needle cylinder is reversed are less visible.

Figure 4:
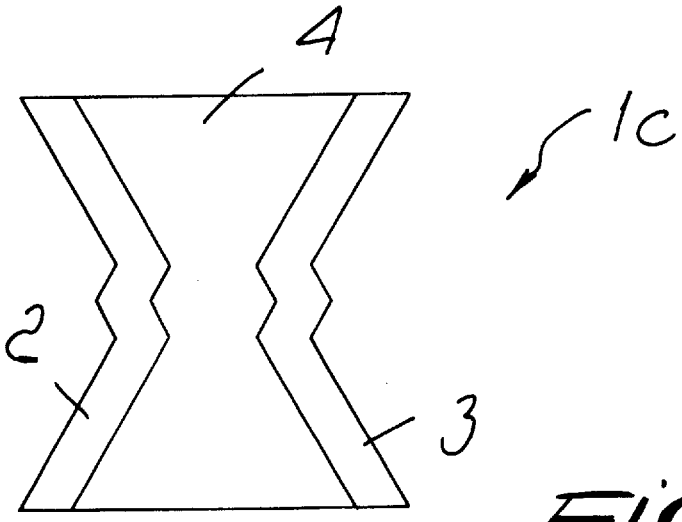

FIG. 4 illustrates a pouch 1*c*, which is formed like the pouch of FIG. 1 except that instead of having simply a gradual decrease in the total number of needles used to form the pouch in a first step and a gradual increase in the number of needles used to form the pouch in a second step, between the first step and the second step there is an intermediate step, in which the number of needles is gradually increased and then the number of needles used to form the pouch is gradually decreased.

In FIG. 4, the number of needles actuated exclusively at one of the two feeds used remains substantially constant along the extension of the pouch 1*c*.

Figure 5:
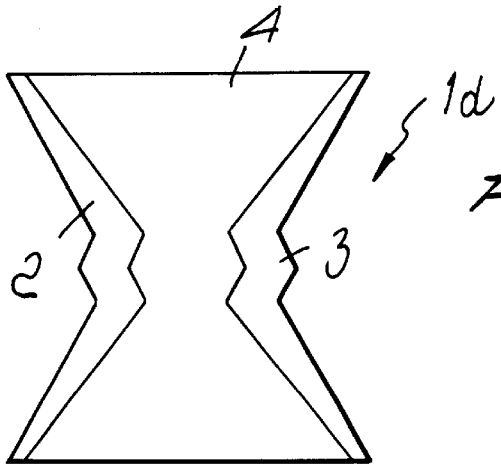

FIG. 5 illustrates a pouch 1*d*, which is formed like the pouch of FIG. 4, except that the number of needles that knit exclusively at one of the two feeds is increased gradually and then decreased gradually in order to obtain the effect already described with reference to FIG. 3.

Figure 6:
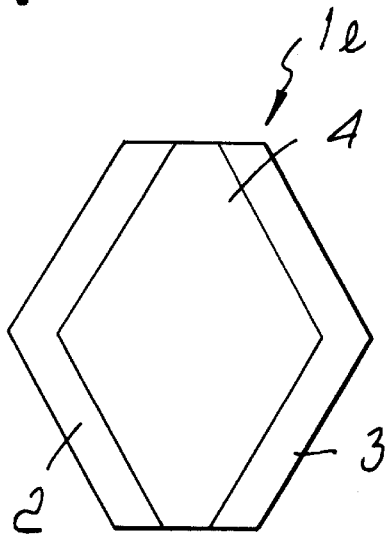

FIG. 6 illustrates a pouch in which the set of needles made to knit at the two feeds A and B, instead of being gradually decreased and then gradually increased, is gradually increased and then gradually decreased.

Figure 7:
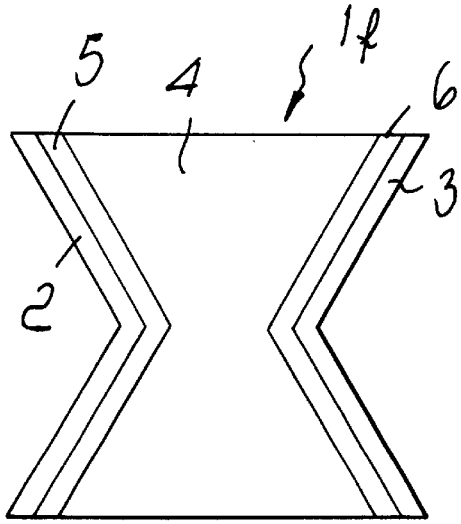
FIG. 7 is a schematic view of a pouch that can be obtained with the method according to the invention by using three feeds or drops.

Finally, FIG. 7 illustrates a pouch 1*f* formed by using three feeds. Said pouch 1*f* has a central region 4, which is formed by using all three feeds, and two end regions 2 and 3, which are formed respectively by using only the feed A and the third feed C, assuming a sequential arrangement along the forward motion of the needle cylinder in which A is the first feed and C is the last feed encountered. Between the central region 4 and the end regions 2 and 3 there is respectively an intermediate region 5, which is formed with the feeds A and B, and an intermediate region 6, which is formed with the feeds B and C.

In practice it has been found that the method according to the invention fully achieves the intended aim, since by using multiple feeds to form the pouch, it reduces significantly the time required to form the pouch and therefore to form the tubular article, particularly a hosiery item, as a whole. By virtue of the particular knitting method used, the pouch has a shape that is fully similar to the shape that can be obtained with conventional knitting that uses a single feed with an alternating motion of the needle cylinder about its own axis and with a degree of finishing, in the points that correspond to the reversal of the motion of the needle cylinder, that is fully satisfactory from an aesthetic standpoint, since the hole effect that can be found in pouches formed according to known types of method that use multiple feeds does not occur.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2002A000630 from which this application claims priority are incorporated herein by reference.

What is claimed is:

1. A method for forming a pouch with a central region and two end regions in a tubular knitted article, with a circular hosiery knitting machine having a needle cylinder rotatable about an axis thereof, a set of needles provided at said needle cylinder, and n feeds or drops, comprising the steps of: making operative for knitting a set of contiguous needles of the needle cylinder; actuating the needle cylinder with an alternating rotary motion about the axis thereof through a rotation angle such as to make the needles of said set that are made operative to knit passing in front of the n feeds or drops which are used to form the pouch; gradually decreasing a number of needles made operative to knit at least one of said n feeds, excluding every time needles located at lateral ends of the needle set in at least one step of the knitting process; and gradually increasing a number of needles made operative to knit at least one of said n feeds at lateral ends of the needle set in at least one other step of the knitting process, each one of the two end regions of the pouch being formed by way of at least two needles that are made operative to knit at one of said n feeds, a first one of said two end regions being formed with one of said n feeds, and a second other of said two regions being formed with a different one of said n feeds.

2. The method of claim 1, wherein the feeds of said n feeds used to form said two end regions of the pouch, are respectively the first and last feeds encountered by said set of needles in an alternating rotary motion of the needle cylinder about the axis thereof.

3. The method of claim 2, wherein the central region of the pouch is made by using all of said n feeds.

4. The method of claim 1, comprising making operative to knit exclusively at a first one of said n feeds encountered in a forward motion and at least feed encountered in a return motion, at least two needles located at a first lateral end of the set of needles used to form n rows of stitches in the forward motion of the needle cylinder and n rows of stitches in the return motion of the needle cylinder, while at least two needles located at a second lateral end of the needle set are made to knit exclusively at a last one of said n feeds encountered in the forward motion and at the first feed in the return motion of the needle cylinder, increasing or decreasing by at least one needle, starting from the first and second lateral ends of the needle set, a number of needles made operative to knit at least one feed at each reversal of a rotation motion of the needle cylinder.

5. The method of claim 4, wherein a number of needles of said set of needles used to form said end regions of the pouch is decreased differently from a number of needles used to form a remaining part of the pouch.

6. The method of claim 1, comprising using a number of n feeds or drops between 2 and 4.

7. A tubular knitted article, having, at least one pouch provided by way of the method as set forth in claim 1.

8. The tubular article of claim 7, being a hosiery item, said pouch being a toe or a heel of the item.

* * * * *